United States Patent [19]

Bickoff et al.

[11] Patent Number: 4,786,047

[45] Date of Patent: Nov. 22, 1988

[54] DOCUMENT PRESENTOR

[75] Inventors: Charles Bickoff, Avon; William J. Smith, West Hartford; Donald L. Suprise, Waterbury, all of Conn.

[73] Assignee: Magnetec Corporation, Bloomfield, Conn.

[21] Appl. No.: 903,403

[22] Filed: Sep. 2, 1986

[51] Int. Cl.[4] ..... B65H 29/54

[52] U.S. Cl. ..... 271/281; 271/306; 271/207; 271/262

[58] Field of Search ..... 271/242, 245, 246, 262, 271/263, 265, 273, 274, 207, 281, 306

[56] References Cited

U.S. PATENT DOCUMENTS

| | | | |
|---|---|---|---|
| 3,087,725 | 4/1963 | Duncan | 271/306 |
| 3,352,554 | 11/1967 | Menzi | 271/281 |
| 4,025,187 | 5/1977 | Taylor | 271/245 |
| 4,135,804 | 1/1979 | Schoppe | 271/245 X |
| 4,353,274 | 10/1982 | Shimizu | 271/265 X |
| 4,451,030 | 5/1984 | Teeter | 271/265 |

*Primary Examiner*—Richard A. Schacher

*Attorney, Agent, or Firm*—Hayes & Reinsmith

[57] ABSTRACT

Apparatus for conveying a sheet of paper from a power feeder to an exit point including a frame for guiding the moving sheet along a preselected path and including a flexible member between the feeder and the exit point for normally guiding the sheet along the preselected path, the flexible member allowing the sheet to buckle in a direction normal to the plane of and away from the preselected path in response to an obstruction.

13 Claims, 5 Drawing Sheets

DOCUMENT PRESENTOR

BACKGROUND OF THE INVENTION

The present invention relates to a self-clearing apparatus for conveying a strip of paper or the like from a powered feeder to an exit point.

Obstructions in devices feeding paper or the like can cause restrictions in the flow of paper. Such restrictions necessarily require interruption in the flow of the paper from the device and clearing of the obstruction.

The problems of paper flow obstructions are especially troublesome in self-service terminals (lottery terminals, automatic teller machines, etc.) where a receipt or some other document must be presented to the customer by the terminal itself. Obstructions to paper flow in these terminals are common particularly from the customer itself holding the document or by a foreign object. Since most paper conveying devices push the paper out through an exit point, the paper is necessarily unsupported downstream of the feeder. Any obstructions between the paper feeder and the exit point, including obstructions at the exit point itself, will cause a jam. Such restrictions in paper flow may cause problems to develop at other points in the paper conveying device, for example, in a printer.

Prior art paper conveying devices for these applications generally contain a signaling device to stop the flow of paper when a paper flow-restricting obstruction develops. At this point, it is generally necessary for someone to come to the terminal and manually clear the device. Difficulties may occur since the paper may now be jammed in a number of points including, for example, the printer. Access to these areas to clear the obstructed paper flow may be limited. This is a serious disadvantage since further problems may be caused in the course of clearing the obstructed paper.

Bearing in mind, these and other deficiencies in the prior art, it is therefore an object of the present invention to provide an apparatus for conveying paper or the like which has a self-clearing feature for obstructions.

It is another object of the present invention to provide a self-clearing paper conveying apparatus for use in self-service terminals.

It is a further object of the present invention to provide a paper conveying apparatus which reduces down time due to paper jamming.

It is another object of the present invention to provide a self-clearing paper conveying apparatus which minimizes the damage to the paper itself.

Other objects will be in part obvious and in part pointed out in more detail hereinafter.

A better understanding of the objects, advantages, features, properties and relations of the invention will be obtained from the following detailed description and accompanying drawing which set forth an illustrative embodiment and is indicative of the way in which the principle of the invention is employed.

SUMMARY OF THE INVENTION

The present invention relates to an apparatus for conveying a moving strip of paper or the like from a powered feeder downstream to an exit point, which comprises a frame and means on the frame for guiding the moving strip along a preselected path from the feeder to the exit point, the strip guiding means including means between the feeder and the exit point for normally biasing the strip along the preselected path, the strip biasing means allowing the strip to buckle in in a direction normal to the plane of and away from the preselected path in response to an obstruction to the moving strip between the exit point and the biasing means. The invention may also incorporate means between the strip biasing means and the exit point for urging an obstructed strip out of and away from the preselected path.

DETAILED DESCRIPTION OF THE INVENTION

While the present invention is especially useful for conveying paper, it will be understood that the present invention may also be used for conveying any thin flexible material such as plastic film or the like which is conveyed in sheet or strip form and is subject to buckling when jammed downstream of a feeding device.

Figure 1:
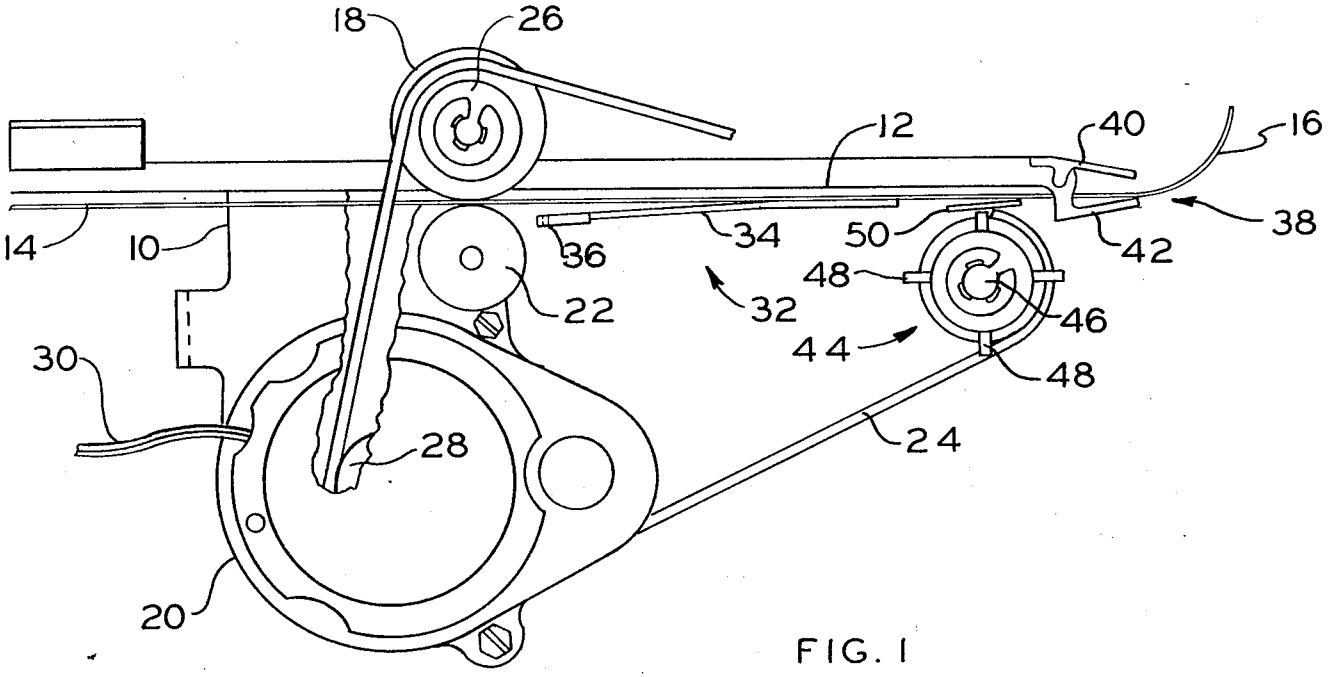
FIG. 1 illustrates a side view of the preferred embodiment of the present invention in a normal paper conveying mode.
Figure 2:
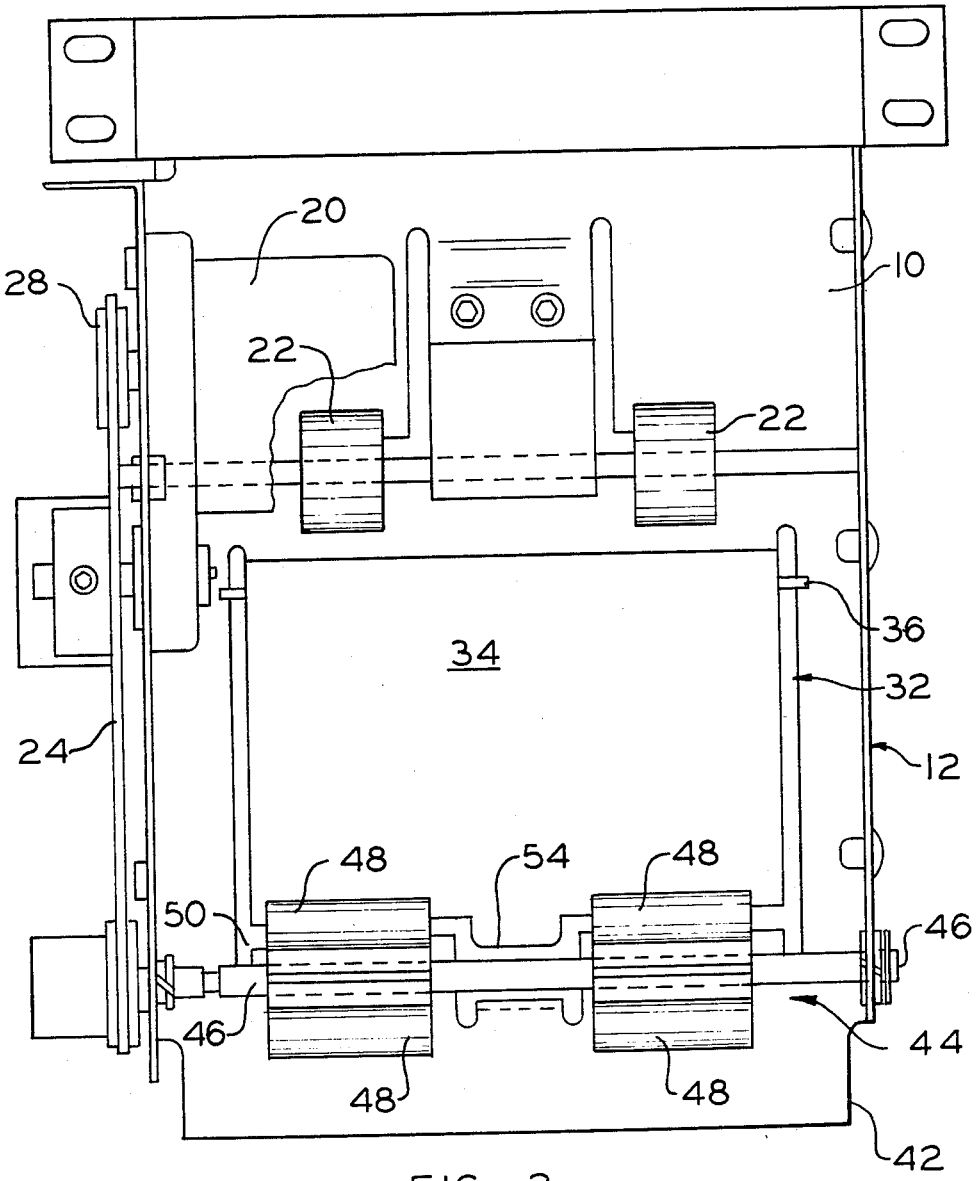
FIG. 2 illustrates a top view of the embodiment of FIG. 1.

In FIGS. 1 and 2 there is shown the preferred embodiment of the present invention in side and top views, respectively, wherein a strip of paper or the like 14 is shown in normal operation being fed without jamming. Paper 14 is guided by a chute which may comprise surfaces above and/or below the normal paper 14 path. An upper chute 12 is held by frame 10 above paper 14 to guide the paper to an exit point 42 wherein paper end 16 is presented. While the present invention is especially suited for conveying paper out of the terminal end of a paper handling device, it will be understood that paper end 16 and exit end 42 may also lead to other handling and conveying equipment. Paper biasing means 32 comprises a flexible Mylar sheet 34 attached at one end 36 to frame 10 and is positioned at the side of the normal paper path opposite and below upper chute 12. "Mylar" is a trademark of the E. I. DuPont de Nemours Co. and signifies a polyester film. Chute 12 and biasing means 32 cooperate to guide the paper 14 from paper feed rolls 18 and 22 to exit point 42. As shown herein, paper 14 passes between powered feed roll 18 and idler roll 22. Feed roll 18 is connected to motor assembly 20 by belt 24 riding on pulleys 28 and 26 on the motor assembly and feed roll, respectively. Motor assembly 20 may be any powered unit and is here shown as an electric motor connected by power cord 30 to a power supply (not shown).

In normal operation, paper 14 travels from the paper feeder rolls 18, 22 to exit point 42 along a preselected path between chute 12 and paper biasing means 32. The end of the flexible sheet 34 opposite attached end 36 is normally biased toward chute 12 to guide paper 14 therebetween along a preselected normal paper path. Both the flexible sheet 34 and the chute 12 have low coefficients of friction with respect to the paper 14 surface to minimize restriction of the paper movement. The flexible sheet 34 is stiffer than paper 14, but may be flexed downward at the end opposite attached end 36 in response to a downward force. As shown in FIG. 2, chute 12 and guiding means 32 extend across the complete width of the paper 14 and allow paper 14 to travel without buckling as it is pushed by feeder rolls 18 and 22 toward exit point 42.

A printer head (not shown) or the like may be incorporated in frame 10 for printing on paper 14. The printer head may be placed upstream of the feeder rolls 18, 22.

As will be further explained, the present invention is particularly useful where the strip of paper 14 or the like is to be fed to exit point 42 in cut lengths as, for example, individual tickets or receipts. In this case, strip 14 cutting means (not shown) will be employed upstream of the feeder rolls 18 and 22.

FIG. 2 illustrates a typical example wherein paper 14 has been obstructed between the feeder rolls 18 and 22 and the exit point 42 of the apparatus. Here there is shown an obstruction 52, at exit point 42 itself, which prevents paper end 16 from moving out of the apparatus. The continuous feeding of paper 14 through feeder rolls 18 and 22 cause the paper 14 to form a buckle, indicated here as 15. Unlike prior art devices wherein paper buckling is largely uncontrolled, paper biasing means 32 allows the buckled portion 15 of paper 14 to move downwards in a direction normal to and away from the plane of the preselected paper path. The movable flexible sheet 34 deflects from the pressure of the paper buckle 15 to move downwards, thereby allowing for controlled buckling of the paper 14. The relative thickness and stiffness of the flexible sheet and the paper 14 may be determined by simple experimentation and should be selected so that the flexible sheet 34 is deflected downwards in a controlled manner when subjected to a paper strip buckle. The flexible sheet 34 should not be deflected by the normal "curl" of paper 14.

As feeder rolls 18 and 22 continue to feed paper 14 towards obstructed exit point 42 and the size of paper buckle 15 increases, paper biasing means 32 also biases the buckled portion 15 of paper 14 against rotatable member 44. Rotatable member 44 comprises a rotatable shaft 46, connected to frame 10, oriented parallel to the plane of the preselected paper path and perpendicular to the direction of paper travel. A plurality of separate axially spaced projections 48 extend radially outward from shaft 46. Projections 48 are preferably made of neoprene or some other elastomeric material having a suitably high coefficient or friction with paper or whatever strip material is being conveyed.

Figure 3:
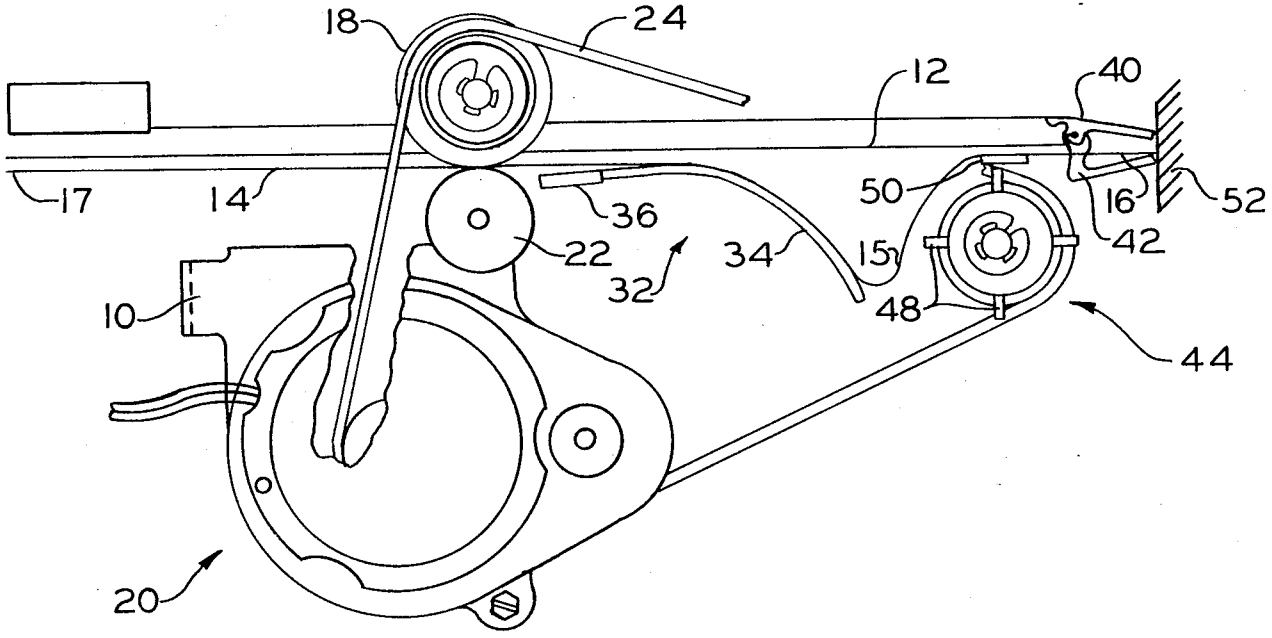
FIGS. 3 and 4 illustrate a side view of the preferred embodiment of the present invention after a paper obstruction has developed.
Figure 4:
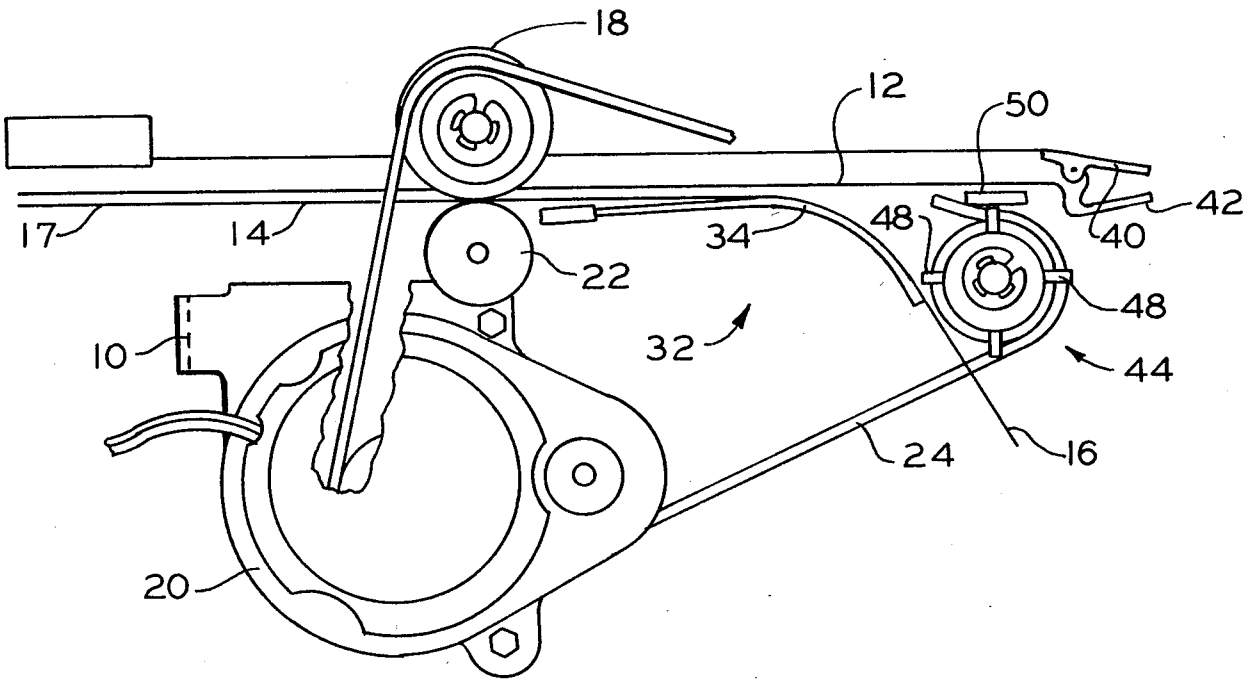
Figure 5:
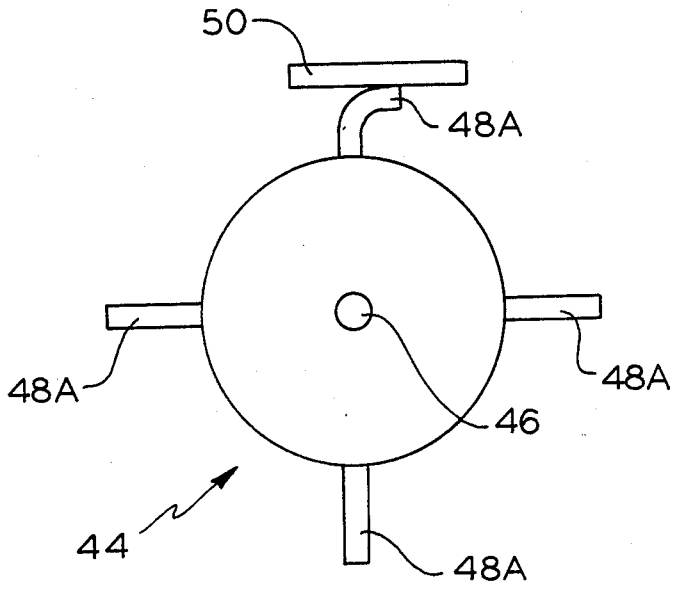
FIG. 5 illustrates an alternative embodiment of the rotatable member depicted in FIGS. 1, 3 and 4.

Rotatable member 44 is spaced apart from the preselected path of the paper so that it does not interfere with normal unobstructed paper flow. A stationary member, here shown as bar 50, is between the rotatable member and the preselected paper path. The leading edge of bar 50 should not be positioned so far upstream that it prevents paper buckled portion 15 from contacting rotatable member 44, nor should it be placed so far downstream that it allows the paper 14 to contact the rotatable member 44 in normal, unobstructed operation. The position of bar 50 may be determined by simple experimentation. As rotatable member 44 rotates in a counterclockwise direction the projections 48 clear the bar 50. In an alternative embodiment, shown in FIG. 5, projections 48a have considerable flexibility and extend a sufficient distance so that as rotatable member 44 rotates, the flexible projections 48a are deflected in turn by the bar 50. Upon further rotation, the projections 48a clear the bar 50 whereupon a springing motion is imparted to the projection as it contacts paper buckled portion 15. The embodiment of rotatable member 44 shown in FIGS. 1, 3 and 4 is preferred where the driving power available to rotate member 44 is limited. Where there are no power limitations and the drag of projections 48a over bar 50 can be accommodated, the embodiment shown in FIG. 5 is preferred.

As shown in FIGS. 3 and 4, as the paper 14 buckles, biasing means 32 urges paper buckled portion 15 against rotatable member 44. A tab 54 at the movable end of flexible sheet 34 fits between axially spaced projections 48 to provide better control of buckled portion 15. The movement of rotatable member 44 against buckled portion 15 urges paper strip 14 counter to the direction of normal paper travel and away from the obstruction at exit point 42. With the embodiment of FIG. 5, the springing motion imparted by bar 50 to rotating flexible members 48a is especially useful in drawing leading paper end 16 out from obstructed end 42 and, as shown in FIG. 4, out and away from the preselected normal paper path. As previously stated, the coefficient of friction between the projections 48 and the paper 14 surface should be high in the manner indicated. Gravity also assists in pulling the paper out of the apparatus. In this preferred embodiment, rotatable member 44 is also connected by a belt 24 to motor assembly 20 and driven paper feed roll 18. Member 44 rotates so that the portions closest to the preselected normal paper feed path and buckled portion 15 are moving counter to the normal travel of the paper strip. The rotation here is shown as being counter clockwise in this side view.

To further protect against the possibility of paper jamming, a guard may be installed at the exit point, here shown as a flap 40 over exit point 42, to prevent foreign objects from being pushed inside the apparatus and restricting paper travel.

As seen in the sequence in FIGS. 3 and 4, following jamming of paper 14 by obstruction 52, paper end 16 is quickly and easily cleared from the obstruction, away from the normal paper path and free of the apparatus. Upon clearing of the obstruction 52, paper 14 may now be easily refed through the exit point 42. Biasing means 34 provides a simple and efficient "trap door" to the paper which allows continued movement of the paper without damaging the paper itself. This enables the jammed portion of the paper to be saved and reused.

Where paper 14 is continued to be fed so that trailing paper end 17 passes feeder rolls 18 and 22, rotatable member 44 may continue to draw paper 14 out of the preselected normal paper path until trailing paper end 17 is also drawn out, thereby completely clearing paper 14 and allowing it to fall away from the apparatus. At this point, flexible sheet 34 of paper biasing means 32 moves back toward and is in position to cooperate with chute 12 to guide a new strip of paper along the normal preselected paper path.

The present invention is useful with a printer wherein the control over the paper buckle which the present invention provides will serve to minimize jamming and overstriking at the print head itself, thus preventing further problems from developing. The movement of paper end 16 by rotatable member 44 to a position clear of the apparatus also makes rethreading and repositioning of the paper more convenient.

The present invention is particularly useful in dispensing cut lengths of paper 14 as individual tickets or receipts. In many instances the obstruction which causes paper jamming is temporary, for example, if a user intentionally or unintentionally obstructs exit point 42 during a transaction. During such obstruction, the individual lengths of paper 14 would be cleared completely out of the paper path and fall away from the apparatus. Should the obstruction be removed, the present invention provides that paper guiding means 12 and paper biasing means 32 will cooperate to guide the subsequent individual paper lengths along the normal preselected paper path and out through the exit point 42. Thus, the terminal or other paper conveying apparatus can be placed back in service for subsequent users without the necessity for a service call to clear the jammed paper.

As will be apparent to persons skilled in the art, various modifications, adaptations and variations of the foregoing specific disclosure can be made without departing from the teaching of this invention.

Having thus described this invention, what is claimed is:

1. An apparatus for consecutively conveying a plurality of sheets of paper or the like from a powered feeder downstream to an exit point and for clearing an impeded sheet of paper from blocking the exit point, said apparatus comprising a frame and means on said frame for guiding each of said moving sheets along a preselected path from said feeder to said exit point, the sheet guiding means including flexible sheet means between said feeder and said exit point for normally biasing each moving sheet in a flat configuration along said preselected path, said sheet biasing means allowing a sheet to buckle in a direction normal to the plane of and away from said preselected path in response to an obstruction to said moving sheet between said exit point and said biasing means and means for clearing the buckled sheet from the sheet path.

2. The apparatus of claim 1 wherein said guiding means comprises a chute on one side of said preselected sheet path and wherein said sheet biasing means comprises a surface movable toward and away from said chute on the other side of said preselected sheet path.

3. The apparatus of claim 2 wherein said movable surface comprises a flat flexible member aligned along said sheet path and secured to said frame at one end toward said feeder, the opposite end of said flexible member being normally biased toward said chute to hold each of said moving sheet along said preselected path, said opposite end of said flexible member being free to move away from said chute in response to a force from a buckled portion of an obstructed sheet.

4. The apparatus of claim 1 wherein said means for clearing the buckled sheet comprises a rotatable member spaced from said preselected sheet path and positioned to contact the buckled portion of an obstructed sheet to urge said sheet counter to the direction of normal sheet travel and away from said exit point.

5. The apparatus of claim 4 wherein said sheet biasing means urges the buckled portion of an obstructed sheet against said rotatable member.

6. The apparatus of claim 5 wherein said rotatable member includes projections extending radially outwardly from the member axis for contacting the buckled portion of an obstructed sheet.

7. The apparatus of claim 6 wherein said projections are flexible; and further including means for imparting a springing motion to said flexible projections as said projections contact said sheet.

8. The apparatus of claim 7 further including a stationary member between said rotating member and said preselected strip path, said stationary member positioned to deflect said flexible elastic projections as said member rotates and impart said springing motion to said projections.

9. An apparatus for conveying a moving strip of paper or the like from a powered feeder downstream to an exit point, said apparatus comprising a frame, means on said frame for guiding said moving strip along a preselected path from said feeder to said exit point, the strip guiding means including a chute on one side of said preselected strip path, and strip biasing means comprising a surface movable toward and away from said chute on the other side of said preselected strip path, said strip biasing means normally biasing said moving strip along said preselected path, while allowing said strip to buckle in a direction normal to the plane of and away from said preselected path in response to an obstruction to said moving strip between said exit point and said biasing means, and wherein said movable surface comprises a flexible sheet aligned along said strip path and secured to said frame at an end toward said feeder, the opposite end of said flexible sheet being normally biased toward said chute to hold said moving strip along said preselected path, said opposite end of said flexible sheet being free to move away from said chute in response to a force from a buckled portion of an obstructed strip.

10. The apparatus of claim 9 wherein means for clearing a buckled sheet portion is provided and comprises a rotatable member spaced from said preselected sheet path and positioned to contact the buckled portion of an obstructed sheet to urge said sheet counter to the direction of normal sheet travel and away from said exit point and wherein said sheet biasing means urges the buckled portion of an obstructed sheet against said rotatable member.

11. The apparatus of claim 10 wherein said rotatable member includes flexible projections extending radially outwardly from the member axis for contacting the buckled portion of an obstructed sheet.

12. The apparatus of claim 11 further including a stationary member between said rotating member and said preselected sheet path, said stationary member positioned to deflect said flexible elastic projections as said member rotates and imparts said springing motion to said projections.

13. The apparatus of claim 10 wherein said rotatable member is positioned below said preselected sheet path for urging and sheet downward from said preselected path.

* * * * *